US006352392B1

(12) United States Patent
McCartney

(10) Patent No.: US 6,352,392 B1
(45) Date of Patent: Mar. 5, 2002

(54) MINE ROOF SUPPORT CRIB HAVING ONLY TWO OR THREE PLANES, AND METHOD

(75) Inventor: Clifford A. McCartney, Eighty-Four, PA (US)

(73) Assignee: Strata Products (USA), Inc., Marietta, GA (US)

( * ) Notice: Subject to any disclaimer, the term of this patent is extended or adjusted under 35 U.S.C. 154(b) by 0 days.

(21) Appl. No.: 09/415,387

(22) Filed: Oct. 8, 1999

(51) Int. Cl.[7] ..... E04B 1/10
(52) U.S. Cl. ..... 405/288; 52/233; 299/11
(58) Field of Search ..... 405/288–290, 405/273; 299/11; 52/233

(56) References Cited

U.S. PATENT DOCUMENTS 5,427,476 A * 6/1995 Pienaar et al. ..... 405/288
5,746,547 A * 5/1998 Reinmann et al. ..... 405/288
6,079,910 A * 6/2000 Marianski et al. ..... 405/288

* cited by examiner

*Primary Examiner*—David Bagnell
*Assistant Examiner*—Tara L. Mayo
(74) *Attorney, Agent, or Firm*—Ansel M. Schwartz

(57) ABSTRACT

A mine roof support crib. The crib includes a plurality of chocks that are connected together through notches in the chocks to form only three planes with at least two of the planes in perpendicular relation with each other and able to support at least five tons of load. Alternatively, the plurality of chocks that are connected together through notches in the chocks form only two planes which are in perpendicular relation with each other and are able to support at least five tons of load. A mine roof support crib. The crib includes a plurality of chocks that are connected together through notches in the chocks to be able to support at least five tons of load. The plurality of chocks comprises a first type of chock having only one notch on a first side and a second type of chock having at least one notch on a second side. The plurality of chocks is connected together. A method of forming a mine roof support crib.

29 Claims, 19 Drawing Sheets

MINE ROOF SUPPORT CRIB HAVING ONLY TWO OR THREE PLANES, AND METHOD

FIELD OF THE INVENTION

The present invention is related to mine support cribs. More specifically, the present invention is related to mine support cribs having only two or only three planes.

BACKGROUND OF THE INVENTION

Over the last several years, increased attention has been given to more efficient systems of standing support for underground mines. U.S. Pat. No. 5,746,547 teaches a support formed by a plurality of parallel, notched chocks which are assembled to create a singular structure. While unique, this structure has the drawback of being material intensive. In many cases, the device provides more support than is necessary for the task and as such is not cost effective.

Work in the early 1990's by the U.S. Bureau of Mines on wooden crib supports included attempts at stacking timber in an "+" pattern to try to minimize the timber used in building a support. Other attempts provided shallow notches on one surface to improve the "+" pattern stacking. All attempts at such a configuration have met with limited success due to the instability of the non-interlocked structure. These attempts also used square cross-section material (such as 6"×6"×30 chocks) which utilized as much material as conventional 4 point crib.

Also, the system as shown in U.S. Pat. No. 5,746,547 is conceived as a singular stand alone support which is not always desirable particularly when large structures are required to be built. The individual chocks to construct large structures with this device become very impractical for manual construction. A structure such as a quay wall of Iori Kikuchi has been considered but the complexity of stacking the multitude of different components is impractical and does not stabily interlock all components.

SUMMARY OF THE INVENTION

The present invention pertains to a mine roof support crib. The crib comprises a plurality of chocks that are connected together through notches in the chocks to form only three planes with at least two of the planes in perpendicular relation with each other and able to support at least five tons of load.

The present invention pertains to a mine roof support crib. The crib comprises a plurality of chocks that are connected together through notches in the chocks to form only two planes which are in perpendicular relation with each other and are able to support at least five tons of load.

The present invention pertains to a mine roof support crib. The crib comprises a plurality of chocks that are connected together through notches in the chocks to be able to support at least five tons of load. The plurality of chocks comprise a first type of chock having only one notch on a first side and a second type of chock having at least one notch on a second side. The plurality of chocks are connected together.

The present invention pertains to a method of forming a mine roof support crib. The method comprises the steps of placing a first chock having only one notch on a first side in a mine. Then there is the step of linking a second chock having at least one notch on a second side with the one notch of the first chock. Next there is the step of linking a third chock having only one notch on a third side with one notch on a fourth side of the second chock opposing the second side. Then there is the step of linking a desired number of additional chocks onto each other or the first, second or third chocks through notches of the respective chocks until at least two planes are formed.

BRIEF DESCRIPTION OF THE DRAWINGS

In the accompanying drawings, the preferred embodiment of the invention and preferred methods of practicing the invention are illustrated in which:

FIGS. 13*a* and 15*b* show reinforcing means on the ends of chocks G & H, respectively.

DETAILED DESCRIPTION

Figure 1:
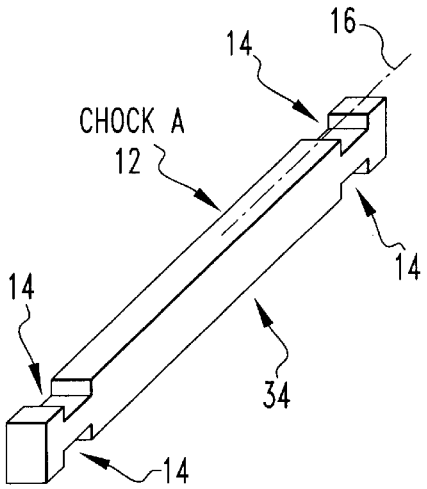
FIG. 1 shows chock A with four notches placed toward the ends of the chock.
Figure 2:
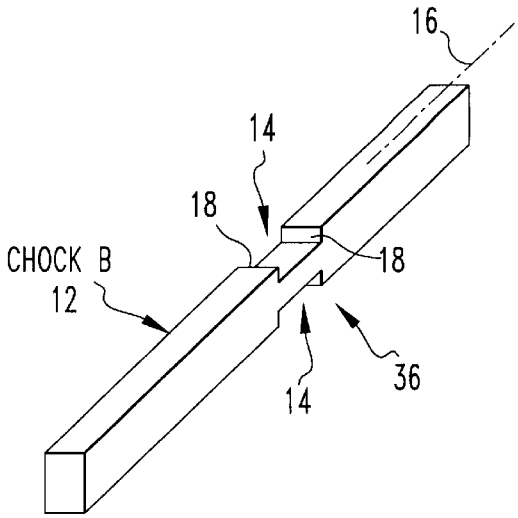
FIG. 2 shows chock B with two notches placed in the center of the chock.
Figure 3:
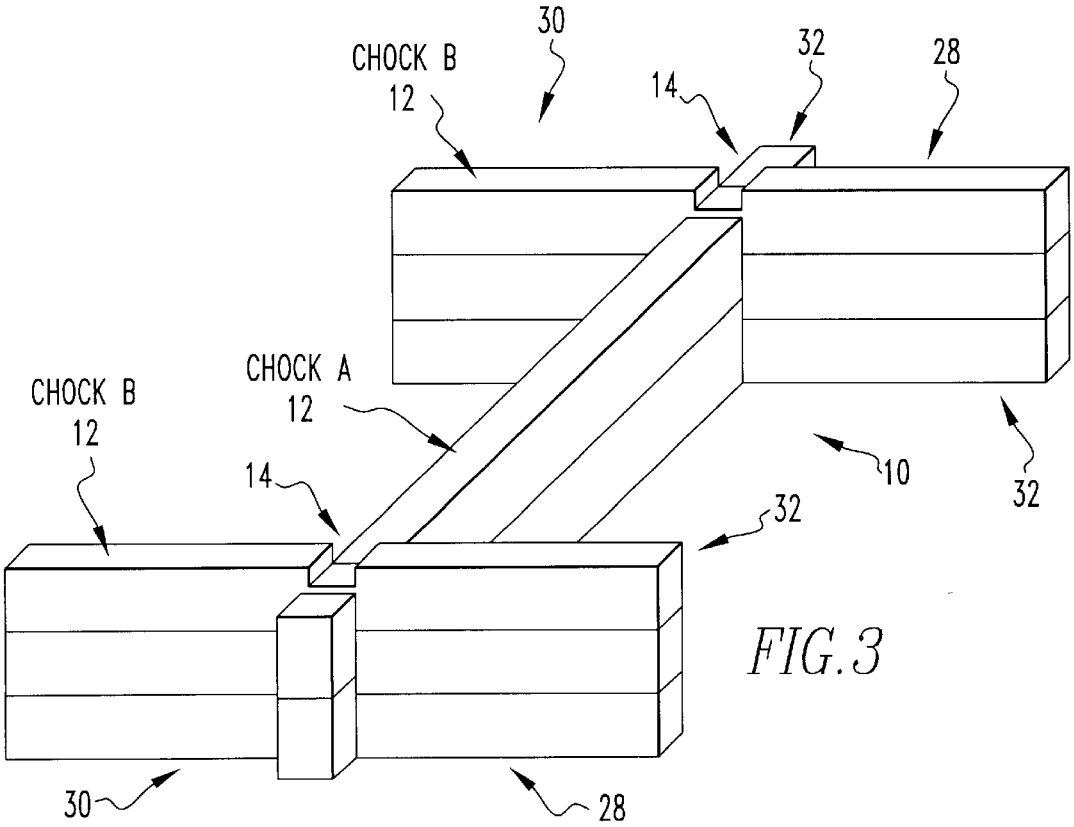
FIG. 3 shows stacking of chocks A & B.

Referring now to the drawings wherein like reference numerals refer to similar or identical parts throughout the several views, and more specifically to FIGS. 1–3 thereof, there is shown a mine roof support crib 10. The crib 10 comprises a plurality of chocks 12 that are connected together through notches 14 in the chocks 12 to form only three planes 32 with at least two of the planes 32 in perpendicular relation with each other and able to support at least five tons of load.

Figure 23:
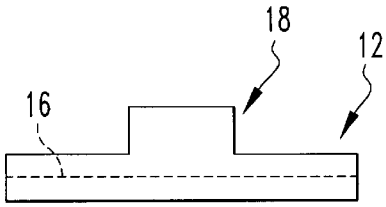
FIG. 23 is a schematic representation of a chock with notches having one edge.

Preferably, the plurality of chocks 12 connected together can support at least 20 tons of load. Each chock 12 preferably has a long axis 16 and each notch 14 of the chock 12 is cut at a right angle to the long axis 16 of the chock 12. Preferably, each notch has at least one edge 18, as shown in FIG. 23. Each notch has preferably at least two edges 18, as shown in FIG. 2. Preferably, each notch 14 has at least two edges 18 which are in parallel with each the other. The rise of each chock 12 can be greater than the width of each chock 12. The width of the notch can be two times the width of the chock 12 and a plane 32 can be comprised of a first arm 28 and a second arm 30 which is offset from the first arm 28.

Figure 20:
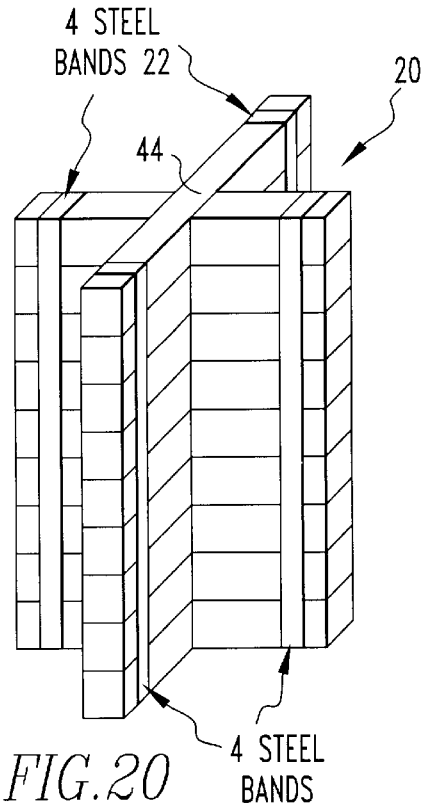
FIG. 20 shows means of securing chocks G as example with steel bands.
Figure 21:
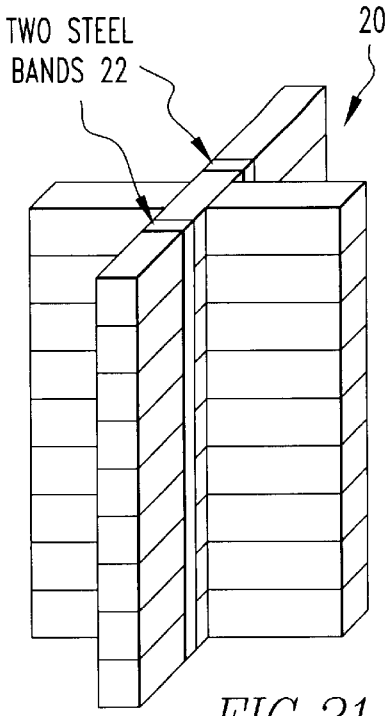
FIG. 21 shows alternative means of securing chocks G with steel bands.
Figure 22:
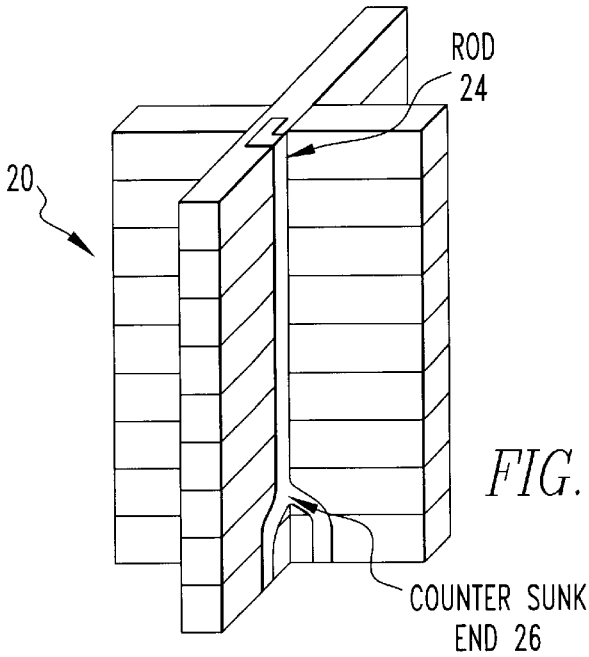
FIG. 22 shows means of securing chocks G with a long tensioned rod with counter-sunk end to allow compression of the structure.

Preferably, the crib 10 includes a mechanism 20 to hold the chocks 12 together. The holding mechanism 20 preferably includes at least one band 22 wrapped around the chocks 12, as shown in FIGS. 20 and 21, or at least one rod 24 with a counter sink-end 26 holding the chocks 12 altogether, as shown in FIG. 22.

Figure 11:
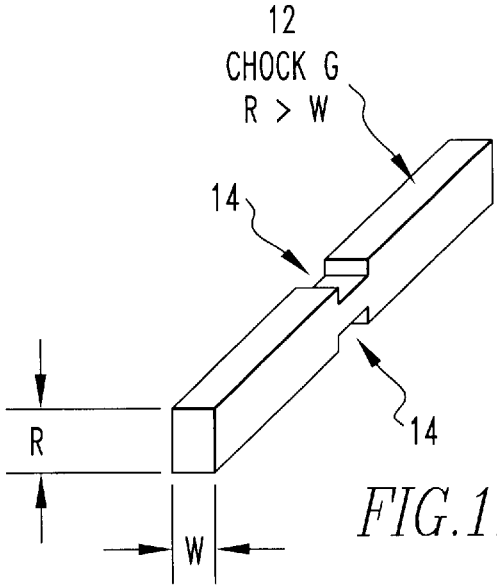
FIG. 11 shows a central position notched, two notch chocks, chock G.
Figure 12:
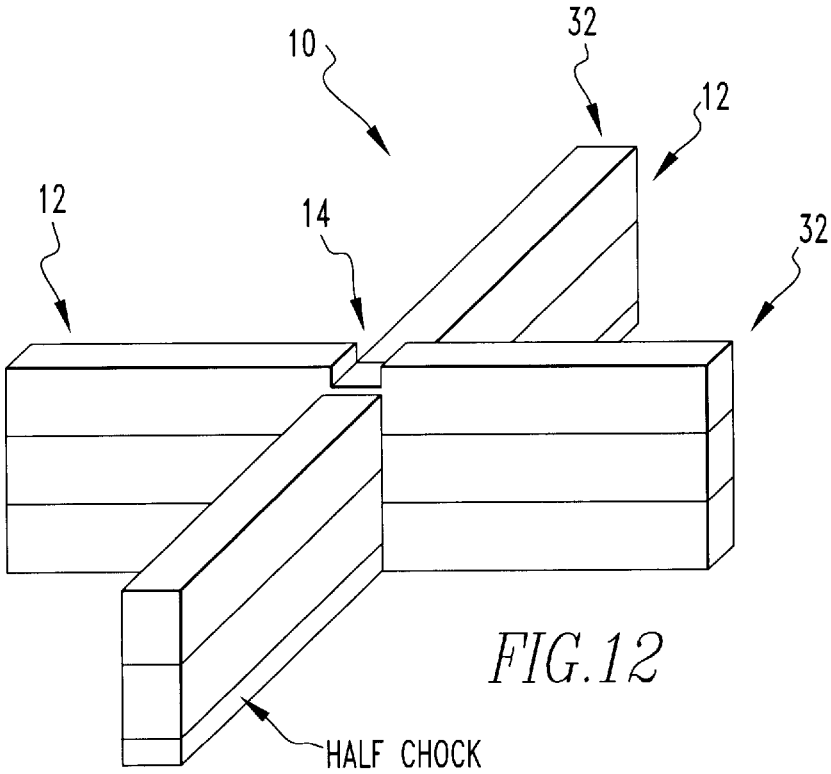
FIG. 12 shows stacking of chocks G.
Figure 12A:
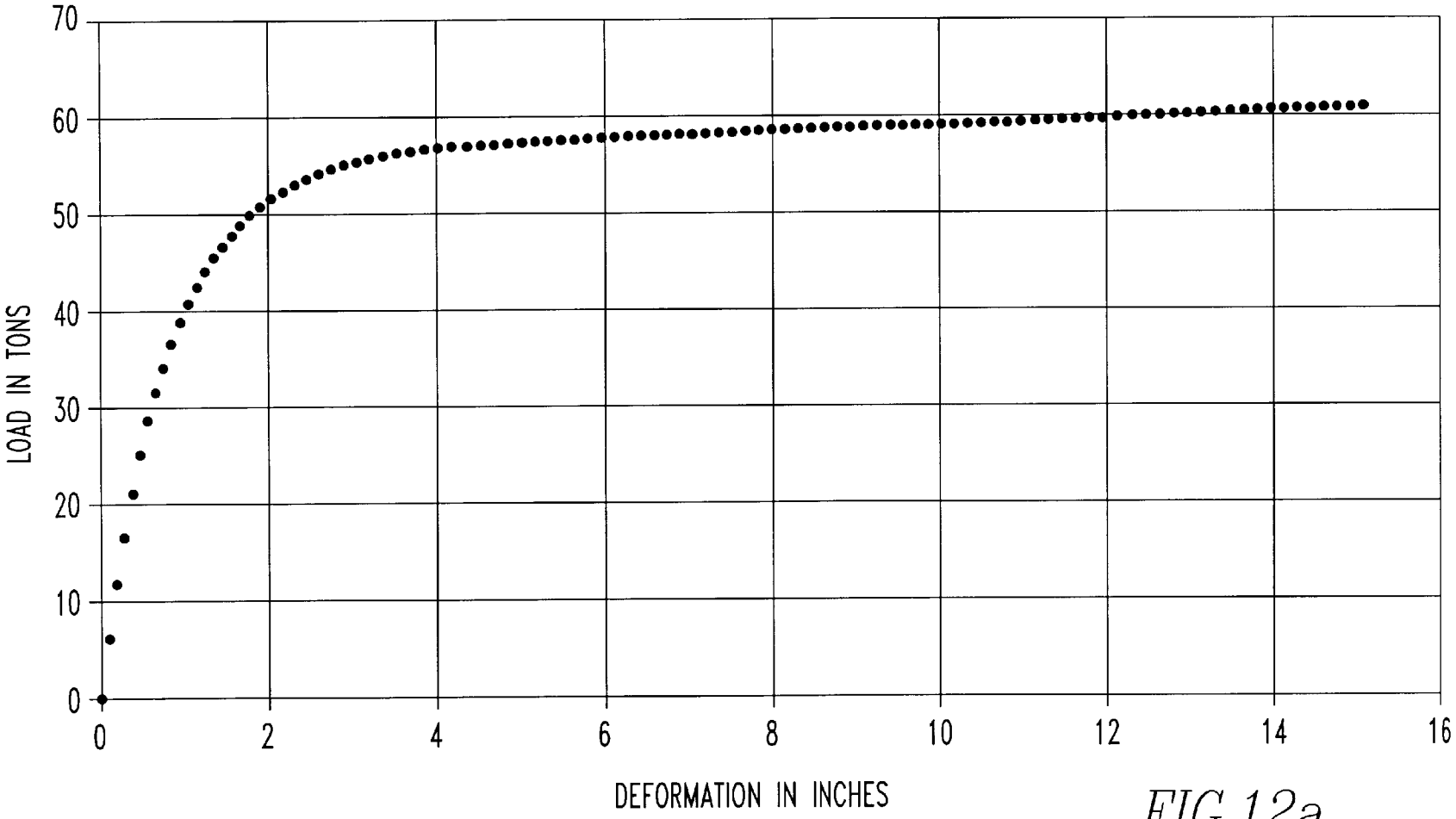
FIG. 12*a* is a graph of support performance of "+" design where the rise of the chock is greater than the width.

The present invention pertains to a mine roof support crib 10, as shown in FIGS. 11 and 12. The crib 10 comprises a plurality of chocks 12 that are connected together through notches 14 in the chocks 12 to form only two planes 32 which are in perpendicular relation with each other and are able to support at least five tons of load, as shown in FIG. 12*a*.

Figure 13:
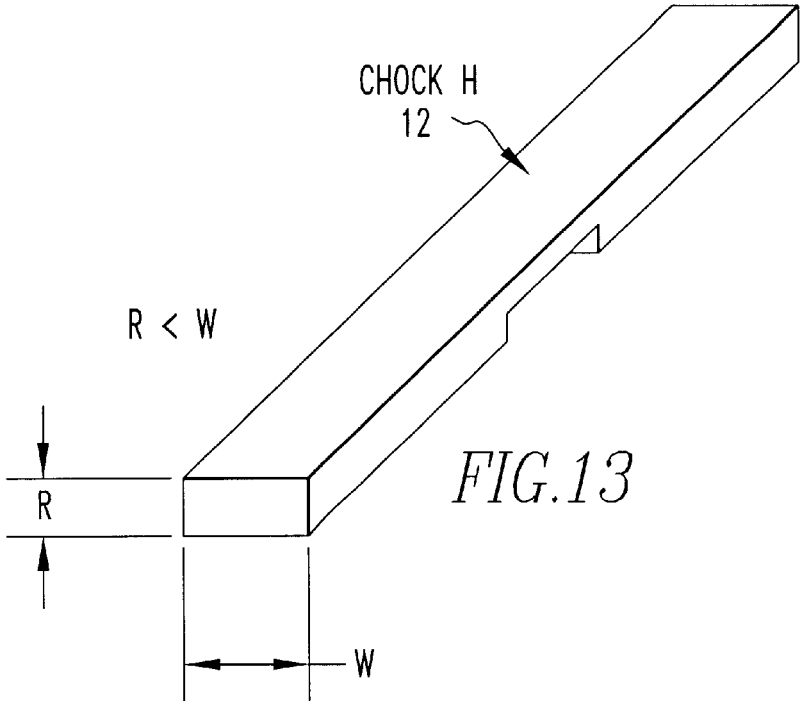
FIG. 13 shows central position notched, single notch chock H.
Figure 14:
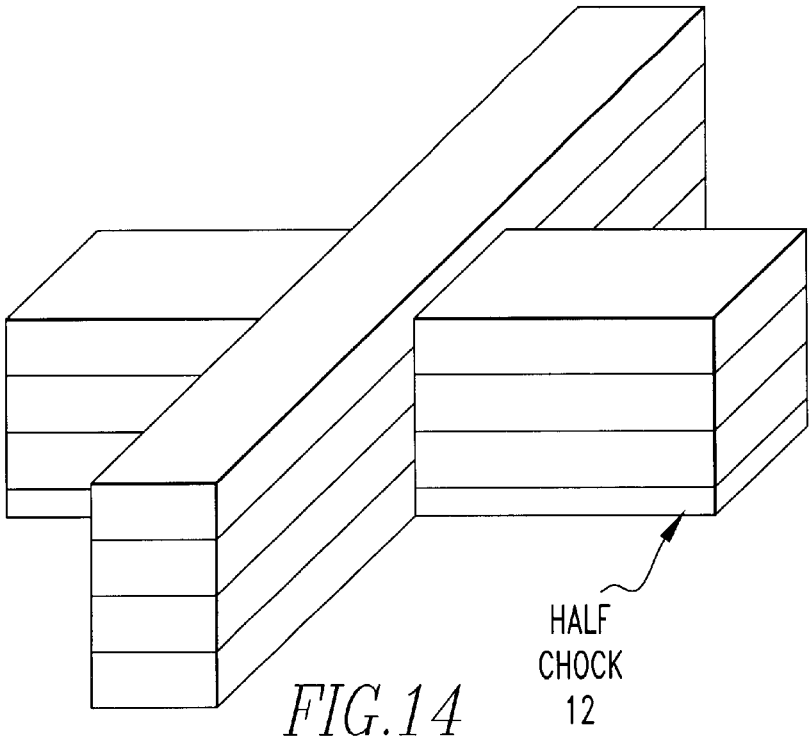
FIG. 14 shows stacking of chocks H.
Figure 14A:
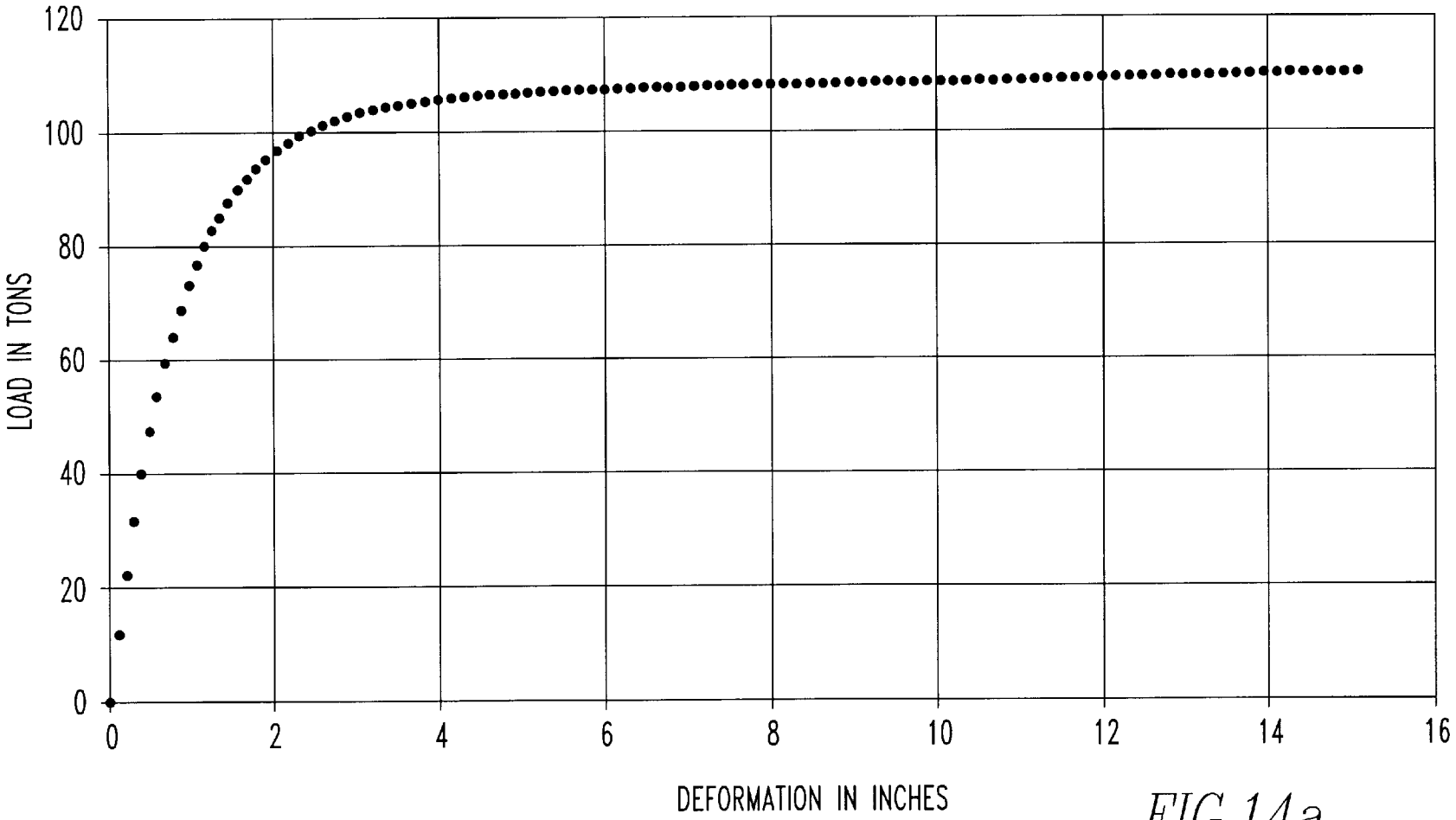
FIG. 14*a* is a graph of support performance of "+" design where the width of the chock is greater than the rise.

The width of each chock 12 can be greater than the rise of each chock 12. The plurality of chocks 12 are preferably connected together and able to support at least 100 tons of load, as shown in FIGS. 13, 14 and 14*a*.

Figure 4:
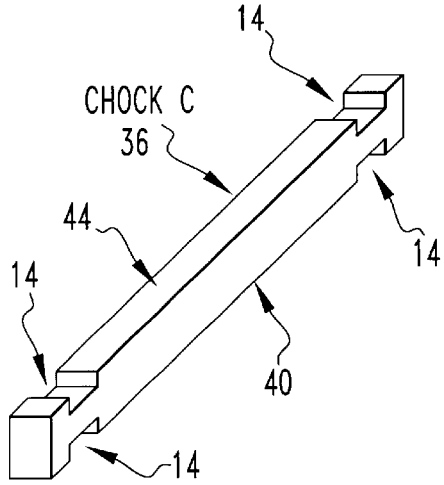
FIG. 4 shows chock C with four notches placed toward the ends of the chock.
Figure 5:
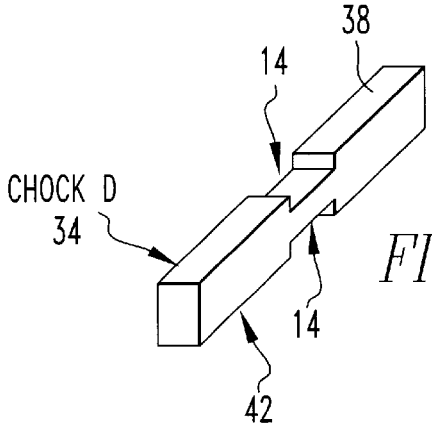
FIG. 5 shows chock D which is shorter than chock C with two notches in the center of the chock.
Figure 6:
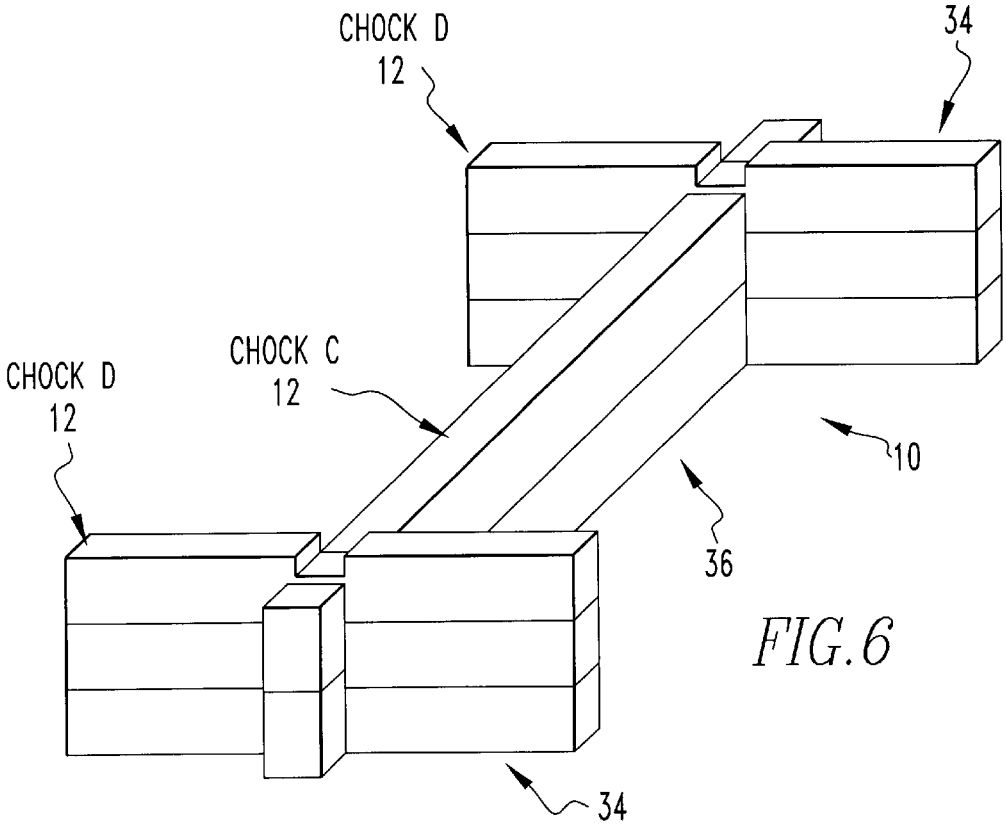
FIG. 6 shows stacking of chocks C & D.

The present invention pertains to a mine roof support crib 10, as shown in FIGS. 4, 5 and 6. The crib 10 comprises a plurality of chocks 12 that are connected together through notches 14 in the chocks 12 to be able to support at least five tons of load. The plurality of chocks 12 comprise a first type of chock 34 having only one notch 14 on a first side 38 and a second type of chock 36 having at least one notch 14 on a second side 40. The plurality of chocks 12 are connected together.

Preferably, the second type of chock 36 has only two notches 14 on the second side 40, as shown in FIG. 1. The first type of chock 34 preferably has only one notch 14 on a third side 42 opposing the first side 38, and the second type of chock 36 has only two notches 14 on a fourth side 44 opposing the second side 40, as shown in FIGS. 1 and 2. Alternatively, the second type of chock 36 has only one notch on the second side 40.

Preferably, the first type of chock 34 and the second type of chock 36 are each one continuous piece. The first type of chock 34 and the second type of chock 36 can be made out of separate pieces glued or nailed together. The first type of chock 34 and the second type of chock 36 are preferably made of wood but can be made out of plastic or metal or a polymeric or cementitious composite of wood, plastic or metal capable of carrying a load in compression.

Figure 15A:
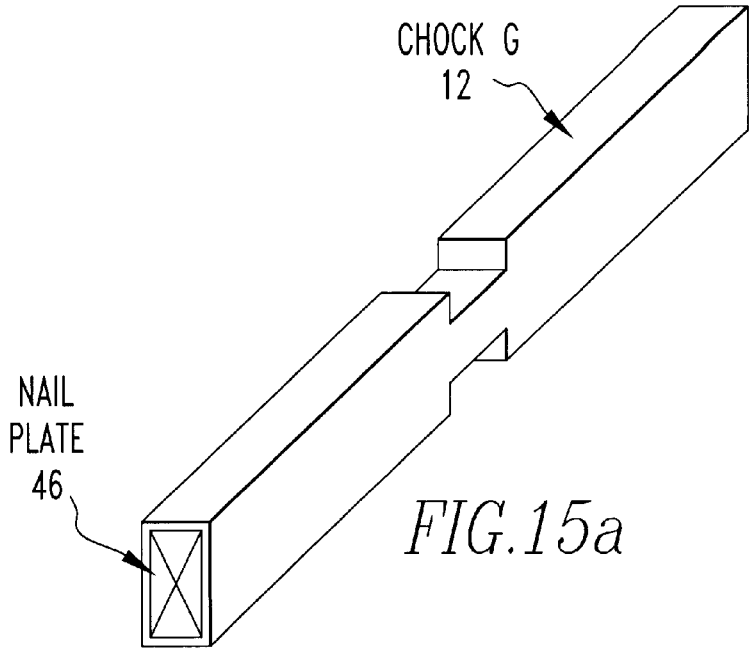
Figure 15B:
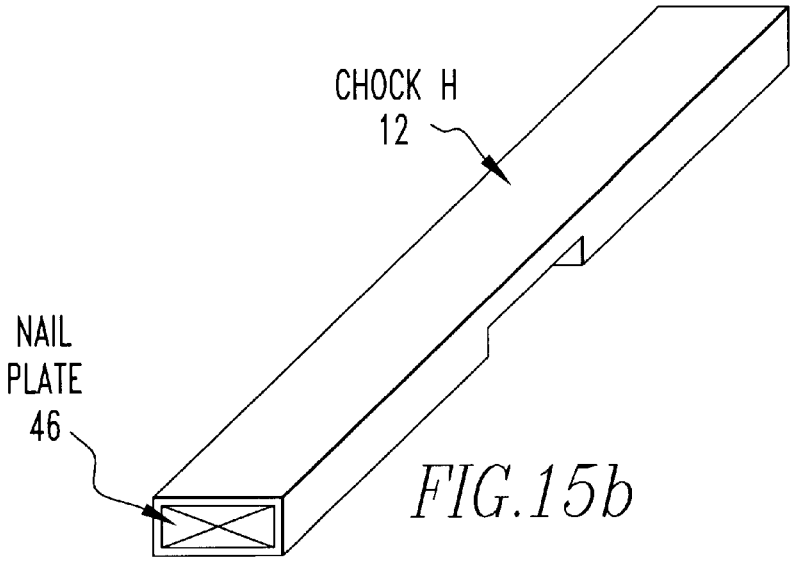

Preferably, the first type of chock 34, and the second type of chock 36 each have a reinforcement mechanism attached to them, as shown in FIGS. 15*a* and 15*b*. The reinforcement mechanism preferably includes a nail plate 46 attached to each end of the first type of chock 34 and the second type of chock 36. Preferably, there are base end 75 and top end 77 pieces, as shown in FIG. 20, which provide a level and stable base and top to the crib 10. Preferably, the rise h=6 inches, the chock width=3.5 inches and the length of the chock=24 inches. Rise can be 2 inches to 12 inches and width can be 2 inches to 12 inches and length greater than 3 times the chock width.

The present invention pertains to a method of forming a mine roof support crib 10. With reference to FIGS. 4–6, the method comprises the steps of placing a first chock having only one notch on a first side 38 in a mine. Then there is the step of linking a second chock having at least one notch on a second side 40 with the one notch of the first chock. Next there is the step of linking a third chock having only one notch on a third side 42 with one notch on a fourth side 44 of the second chock opposing the second side 40. Then there is the step of linking a desired number of additional chocks 12 onto each other or the first, second or third chocks through notches 14 of the respective chocks 12 until at least two planes 32 are formed.

Preferably, after the linking a desired number of additional chocks 12, there is the step of supporting a load of at least 5 tons with the additional chocks 12 and the first, second and third chocks. After the first chock placing step, there is preferably the step of placing a fourth chock having only one notch on a first side 38 in the mine; and wherein the second notch linking step includes the step of linking a second notch of the second chock having only the one notch and the second notch on the second side 40 with the one notch of the fourth chock; and wherein the linking a desired number of additional chocks 12 step includes the step of linking a desired number of additional chocks 12 onto each other or the first, second, third or fourth chocks through notches 14 of the respective chocks 12 until only three planes 32 are formed.

Preferably, before the placing step, there is the step of placing a base end 75 piece on the mine floor to provide a level and stable base to the structure. After the linking a desired number of additional chocks 12 step there is preferably the step of placing a top end 77 piece on the top of the structure to complete the top of the structure. Preferably, after the placing a top end piece step, there is the step of placing a holding mechanism 20 about the chocks 12 to hold them together. The holding mechanism is to allow pre-assembled installation not to hold the chocks together after installation in the mine.

In the operation, various notched crib 10 supports are now described.

Device #1—Using center notched and end notched chocks 12 in the same structure allows stacking in an "HI" configuration. This stacking has the potential to reduce the volume of timber used in building the support by 25% over the device in U.S. Pat. No. 5,746,547 while still using chocks 12 of the same overall dimension.

EXAMPLE 1

FIG. 1. Shows chock 12 A with four notches 14 placed toward the ends of the chock 12.

FIG. 2. Shows chock 12 B with two notches 14 placed in the center of the chock 12.

FIG. 3. Shows stacking of chocks 12 A & B.

Figure 3A:
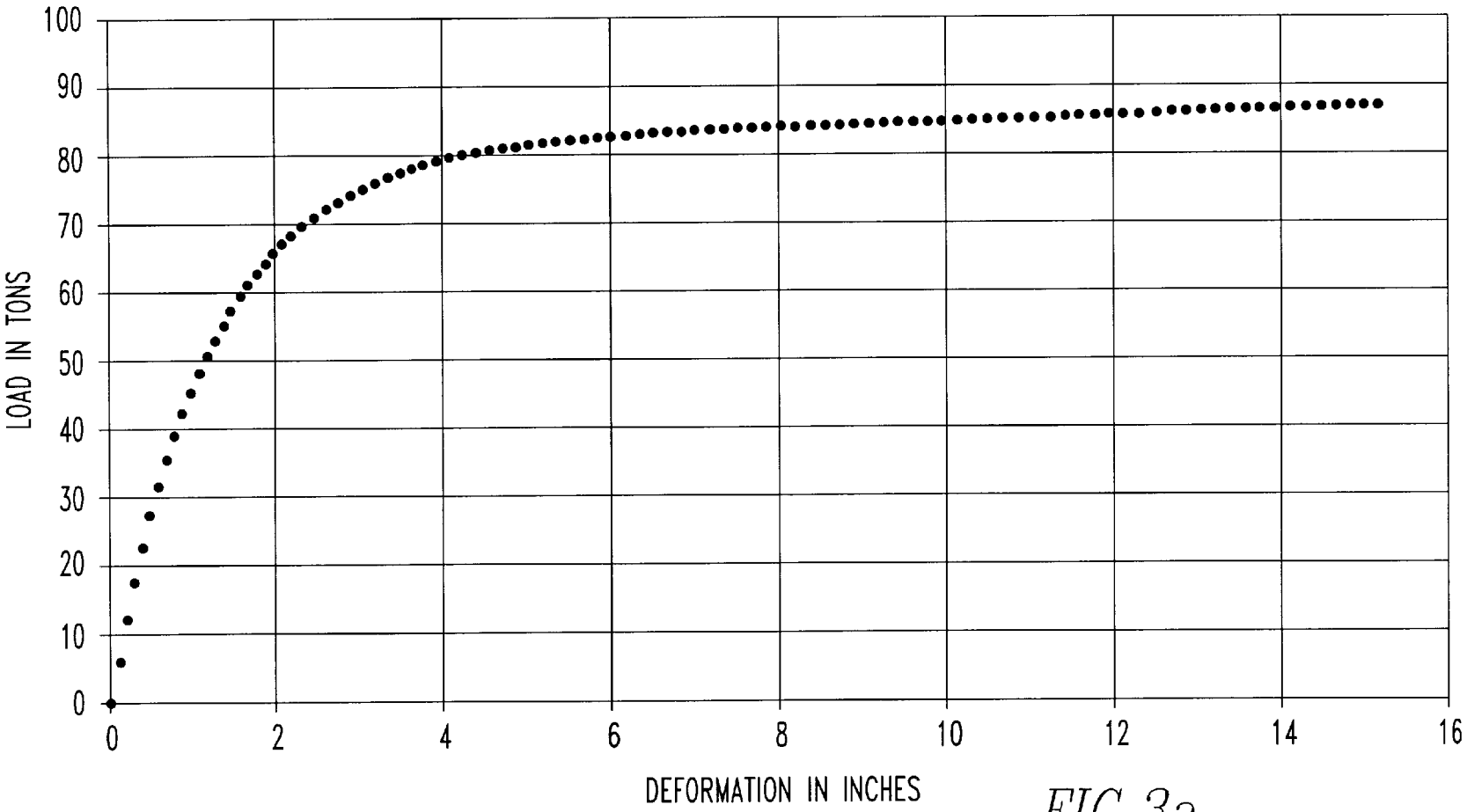
FIG. 3*a* is a graph of support performance of "HH" design where both 2 notch and 4 notch chocks are the same length.

FIG. 3*a*. Shows a graph of support performance of "H" design where both 2 notch and 4 notch chocks are the same length 24" long chocks 6" rise, 3.5" wide and 48" high in regard to FIGS. 1, 2 and 3.

Device #2—Using chocks 12 similar to that in device #1 but with the relative lengths of the chocks 12 different could allow stacking in an "I" configuration and even further savings in material versus devices in U.S. Pat. No. 5,746,547.

EXAMPLE 2

FIG. 4. Shows chock 12 C with four notches 14 placed toward the ends of the chock 12.

FIG. 5. Shows chock 12 D which is shorter than chock 12 C with two notches 14 in the center of the chock 12.

FIG. 6. Shows stacking of chocks 12 C & D.

Figure 6A:
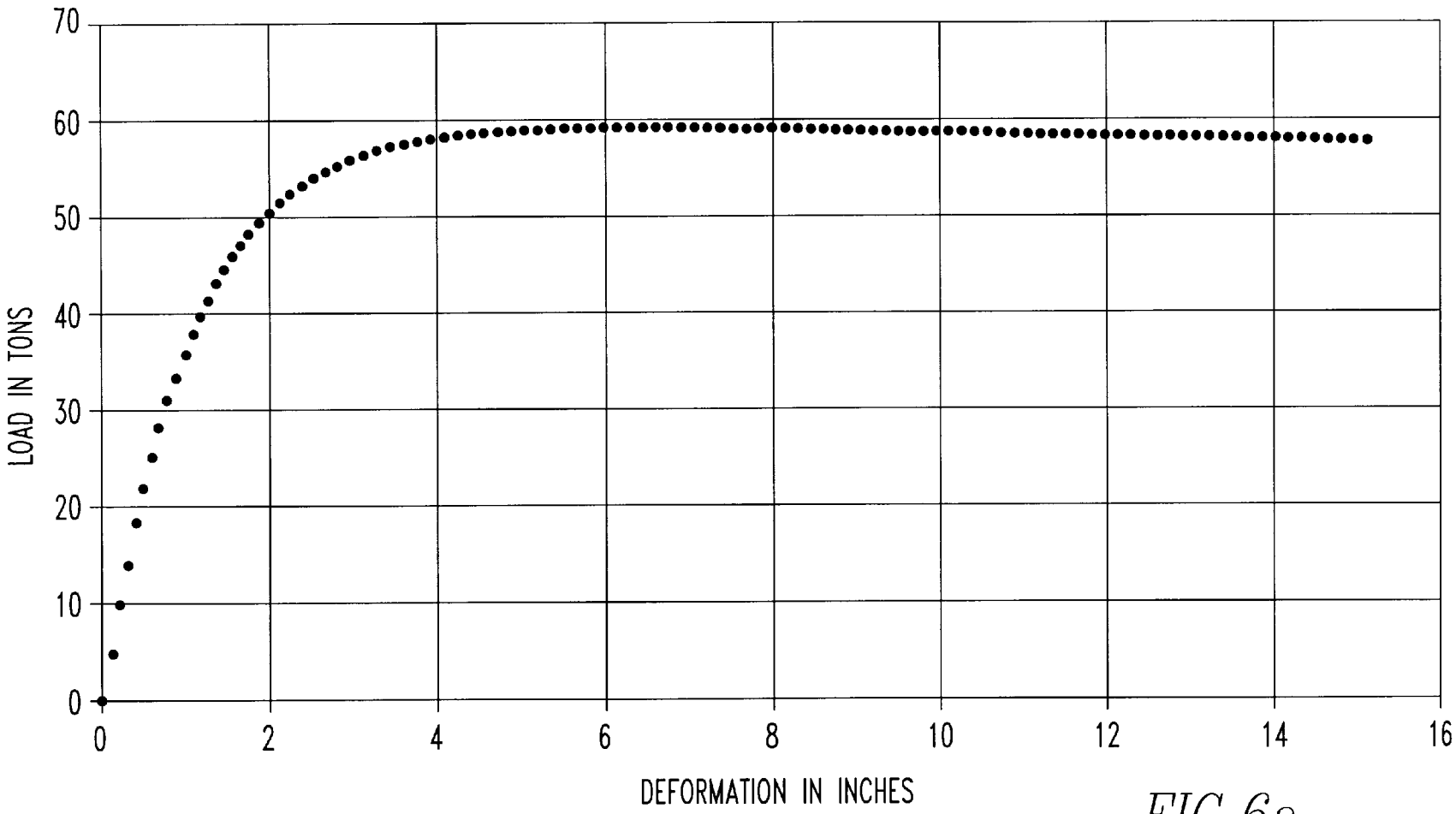
FIG. 6*a* is a graph of support performance of "I" design the length of 2 notch chocks are 16" and 4 notch are 24".

FIG. 6*a*. Shows a graph of support performance of "I" design the length of 2 notch chocks are 16" and 4 notch are 24". For all chocks: 6" rise, 3.5" wide and 48" high, in regard to FIGS. 4, 5 and 6.

Device #3—Using chocks 12 similar to those of device #1 but having the notches 14 of either the four notched chock or the two notched chock located in alternative places along the length of the chock.

EXAMPLE 3

Figure 7:
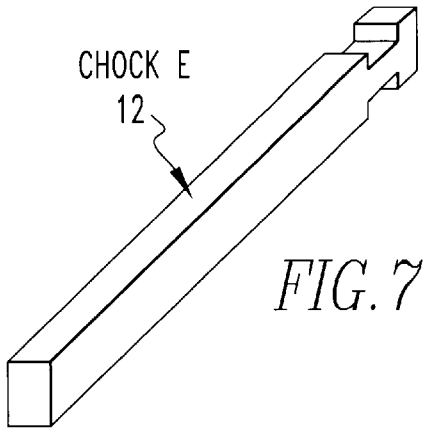
FIG. 7 shows chock E with two notches disposed to one side of the chock.

FIG. 7. Shows chock 12 E with two notches 14 disposed to one side of the chock 12.

Figure 8:
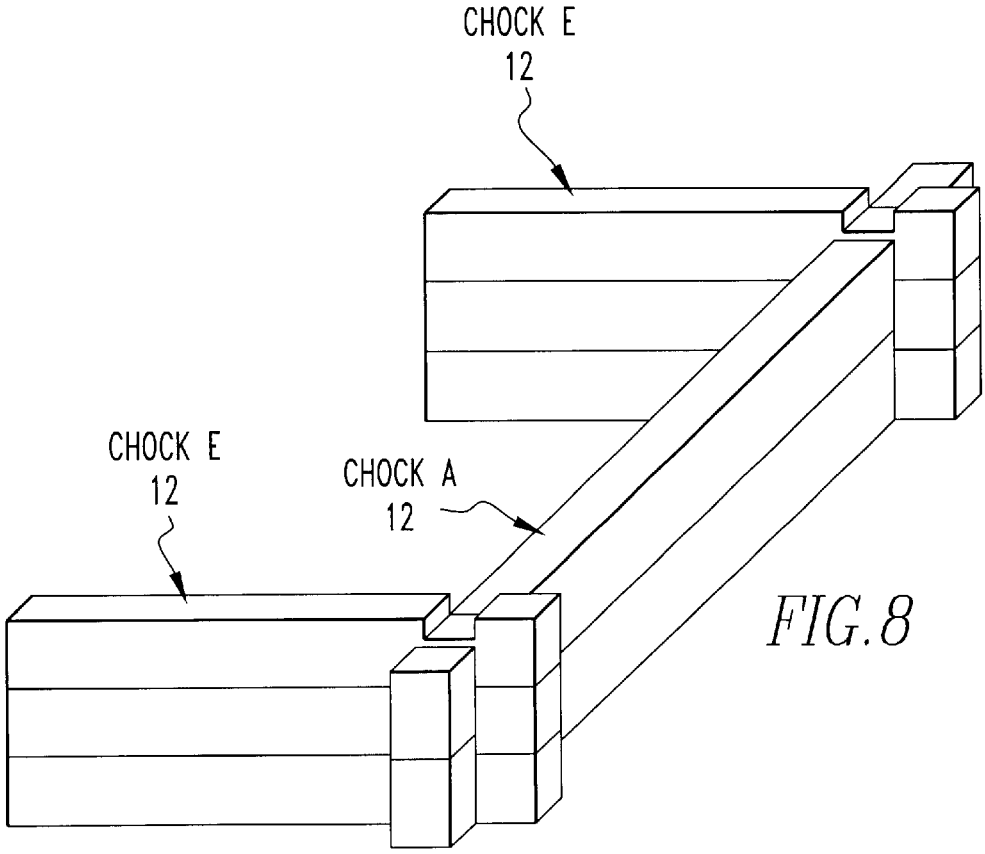
FIG. 8 shows stacking of chocks A & E.

FIG. 8. Shows stacking of chocks 12 A & E.

Figure 8A:
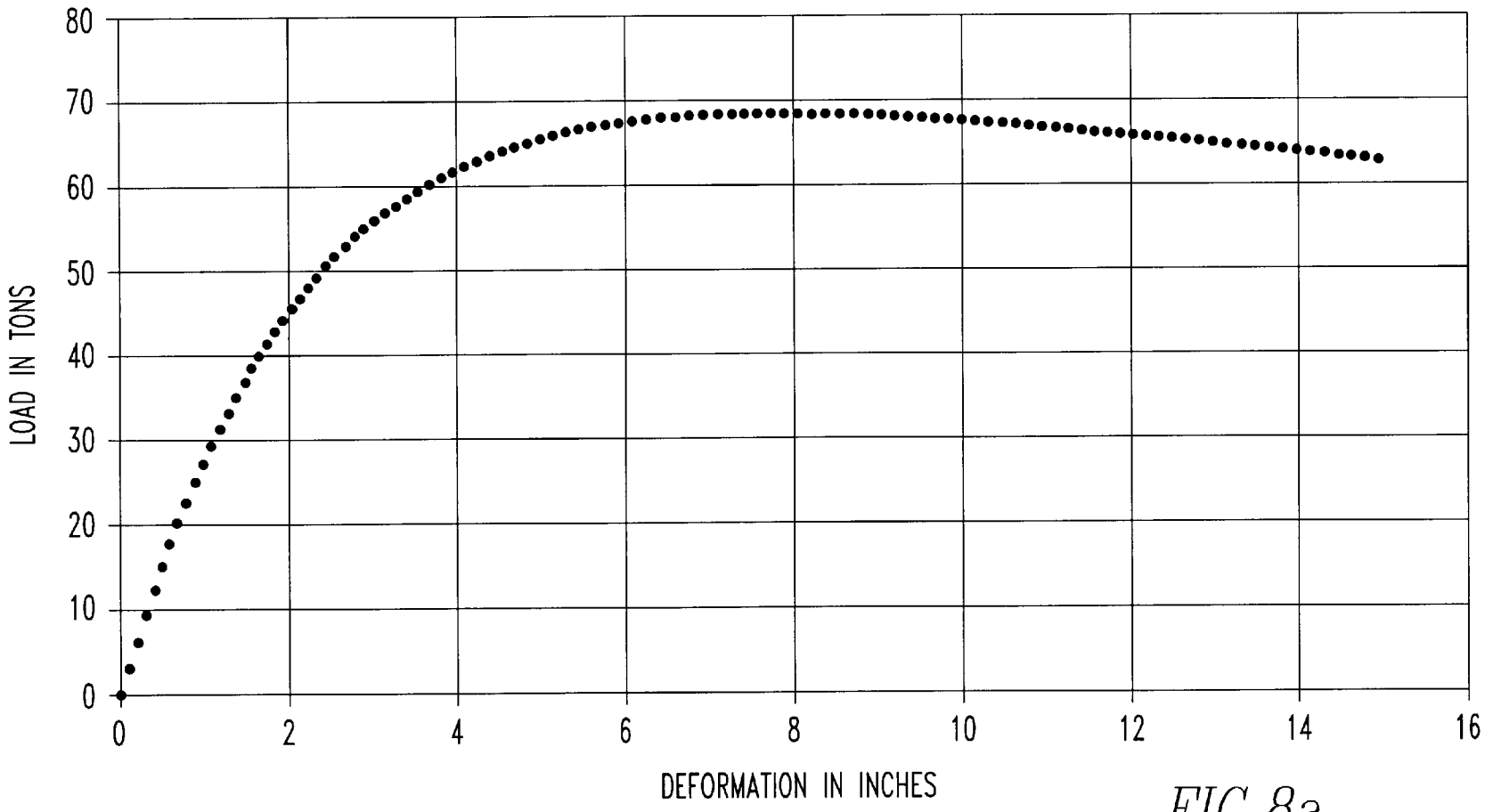
FIG. 8*a* is a graph of support performance of "C" design the length of 2 notch and 4 notch chocks is 24".

FIG. 8*a*. Shows a graph of support performance of "C" design the length of 2 notch and 4 notch chocks is 24". For all chocks: 6" rise, 3.5" wide and 48" high, in regard to FIGS. 7 and 8.

EXAMPLE 4

Figure 9:
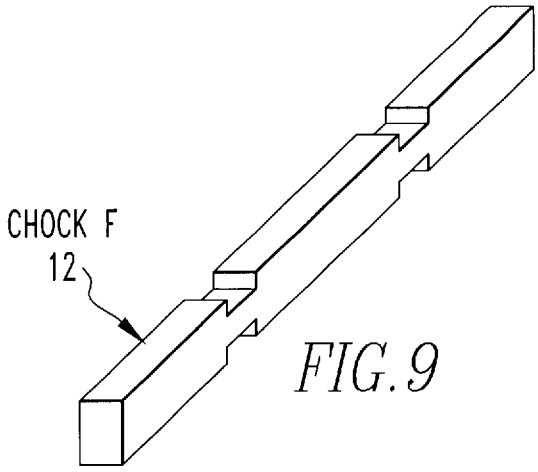
FIG. 9 shows chock F with four notches disposed toward the center of the chock.

FIG. 9. Shows chock 12F with four notches 14 disposed toward the center of the chock 12.

Figure 10:
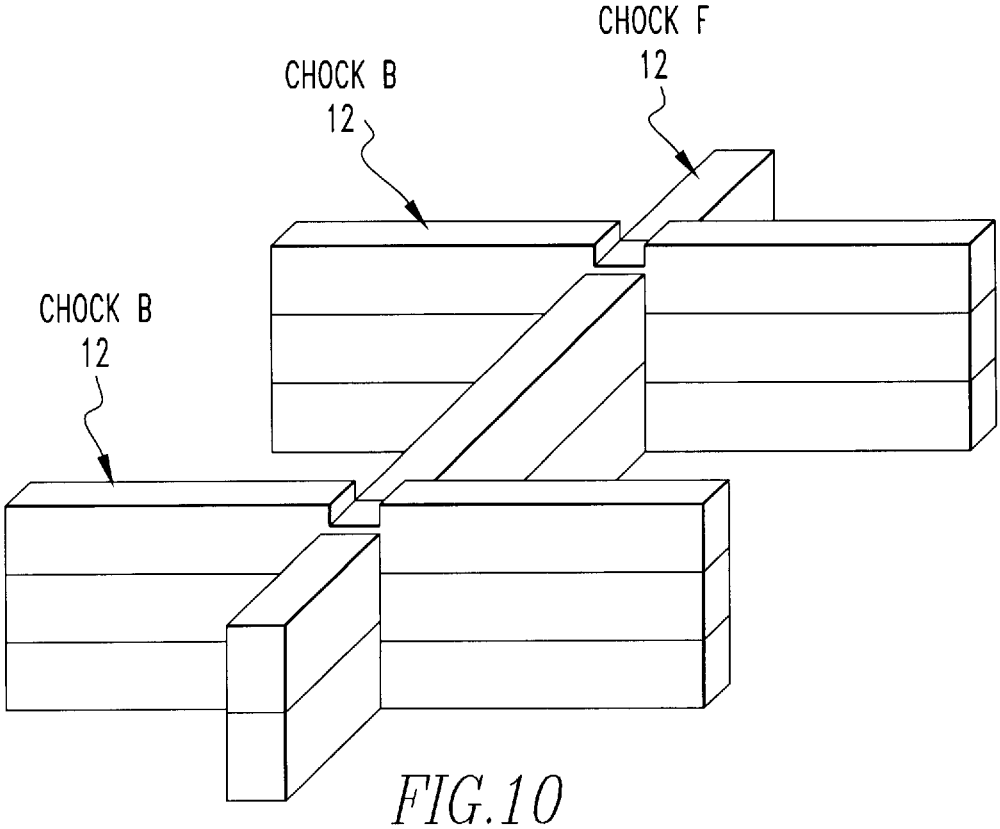
FIG. 10 shows stacking of chocks F & B.

FIG. 10. Shows stacking of chocks 12F & B.

Figure 10A:
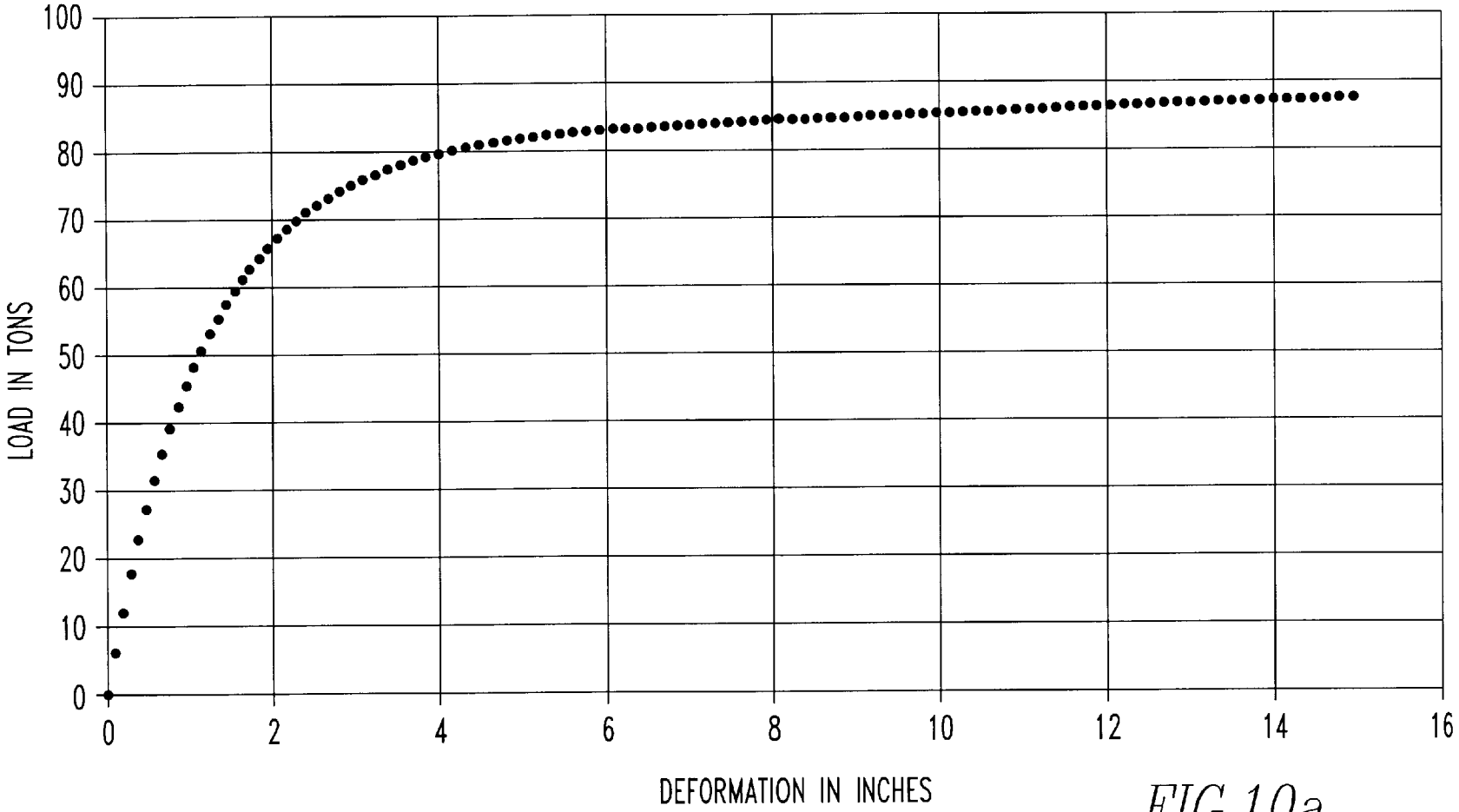
FIG. 10*a* is a graph of support performance of "+" design notches of the 4 notched chock disposed toward the center of the chock.

FIG. 10*a*. Shows a graph of support performance of "H" design notches of the 4 notched chock disposed toward the center of the chock as opposed to the sides, as shown in FIG. 3. All chocks 24" long 6" rise, 3.5" wide and 48" high, in regard to FIGS. 9 and 10.

As can be foreseen by the above, many additional specific forms could be created by the repositioning of the notches 14.

Device 4—Alternative means of creating a stable support with a "+" form. Example 5 in which the rise of the chock 12 is greater than the width, produces a dramatic reduction in material versus a conventional 4 point crib 10 while still developing an improved initial stiffness (FIG. 11). Example 6 improves the stability of the support versus earlier attempts by maintaining the rise of the chock 12 to be less than the width (FIG. 3). Example 7 shows one possible means of reinforcing the chocks 12 of Examples 5 & 6 with a "nail plate 46" (FIGS. 15*a* and 15*b*). This improves the post yield performance of the chock 12 if it is made of timber.

EXAMPLE 5

FIG. 11. Shows a central position notched, two notch chocks 12, chock 12 G.

FIG. 12. Shows stacking of chocks 12 G.

FIG. 12*a*. Shows a graph of support performance of "+"design where the rise of the chock is greater than the width. 24" long chocks, 6" rise, 3.5" wide, 48" high, in regard to FIGS. 11 and 12.

EXAMPLE 6

FIG. 13. Shows central position notched, single notch chock 12 H.

FIG. 14. Shows stacking of chocks 12 H.

FIG. 14*a*. Shows a graph of support performance of "+"design where the width of the chock is greater than the rise. 24" long chocks, 4" rise, 6" wide and 48" high, in regard to FIGS. 13 and 14.

EXAMPLE 7

FIG. 15. Shows reinforcing means on the ends of chocks 12 G & H.

Device 5—Means of creating a "interlocked" large support structure by creating notches 14 with a dimension of at least twice the width of the chock 12.

EXAMPLE 8

Figure 16:
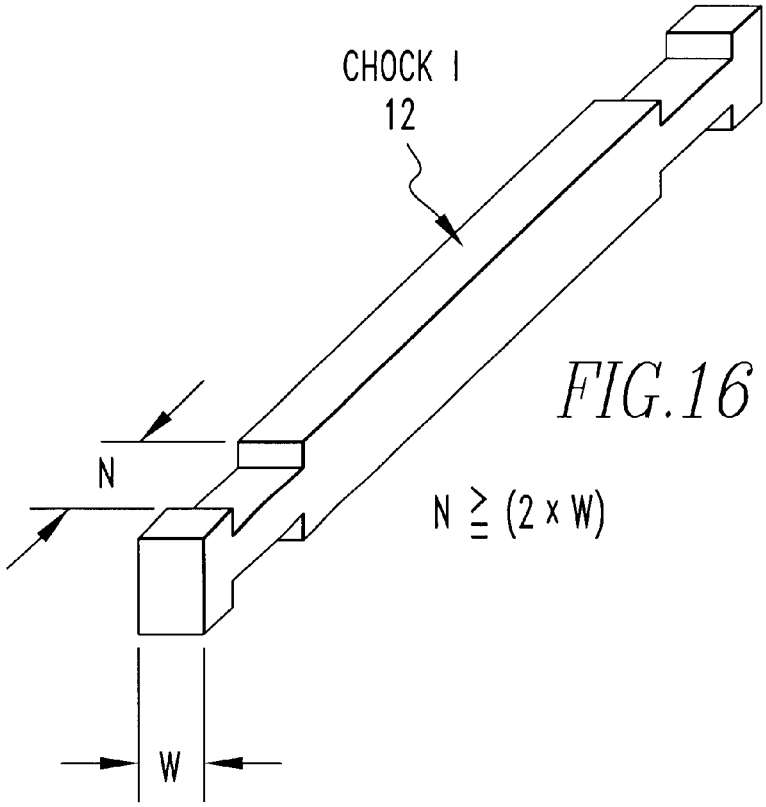
FIG. 16 shows chock I with four notches with a width of each notch at least equal to twice the width of the chock.

FIG. 16. Shows chock 12 I with four notches 14 with a width of each notch at least equal to twice the width of the chock 12.

Figure 17:
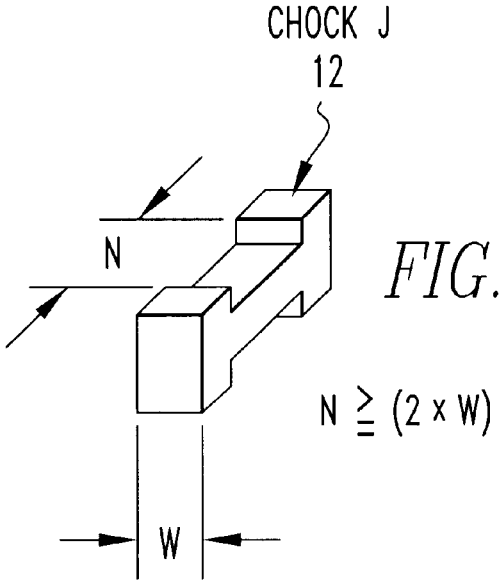
FIG. 17 shows one configuration of filler chock J, which may be used in construction.

FIG. 17. Shows one configuration of filler chock 12 J, which may be used in construction.

Figure 18:
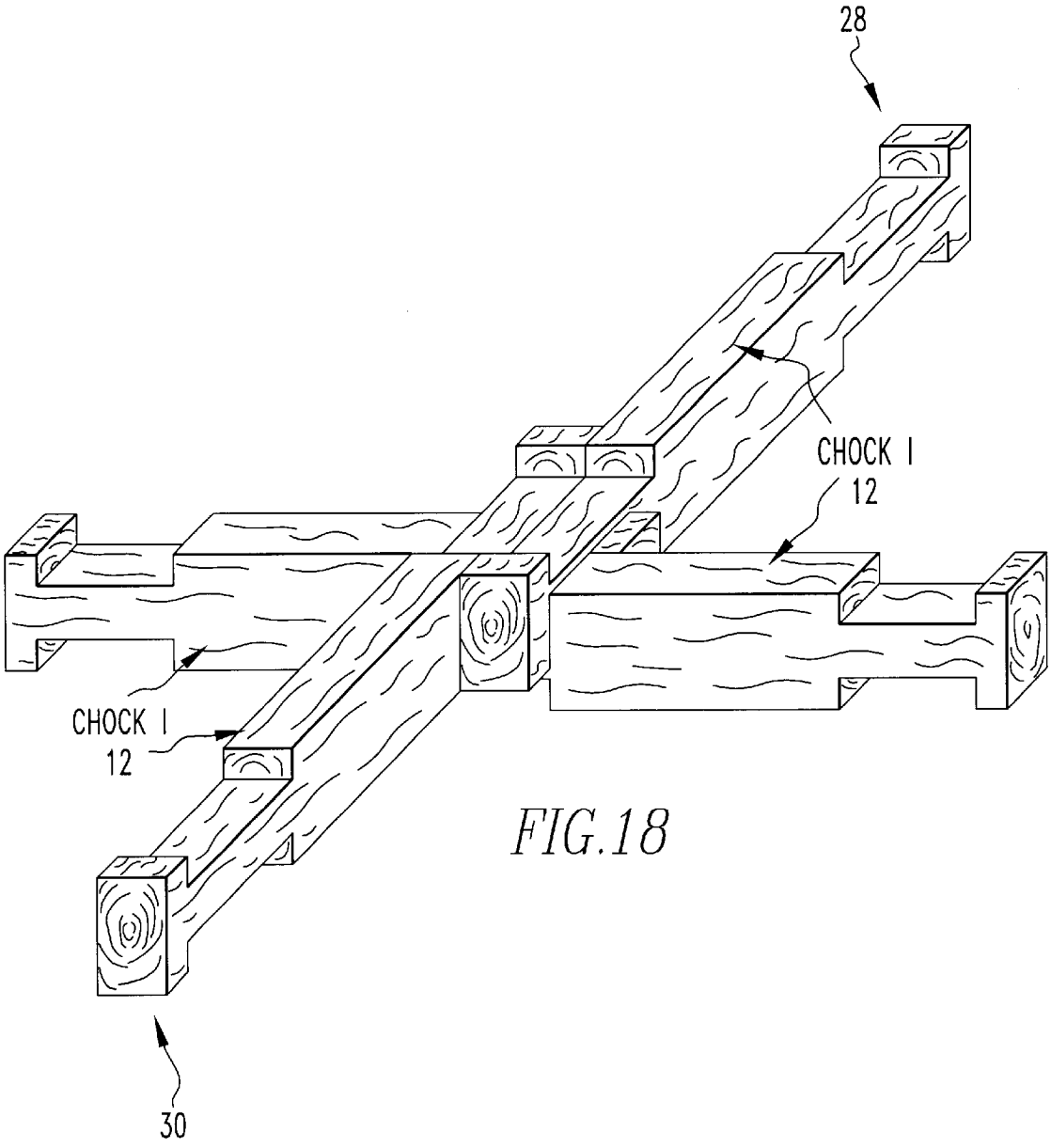
FIG. 18 shows interlock of a plurality of chock I.

FIG. 18. Shows interlock of a plurality of chock 12 I.

Figure 19:
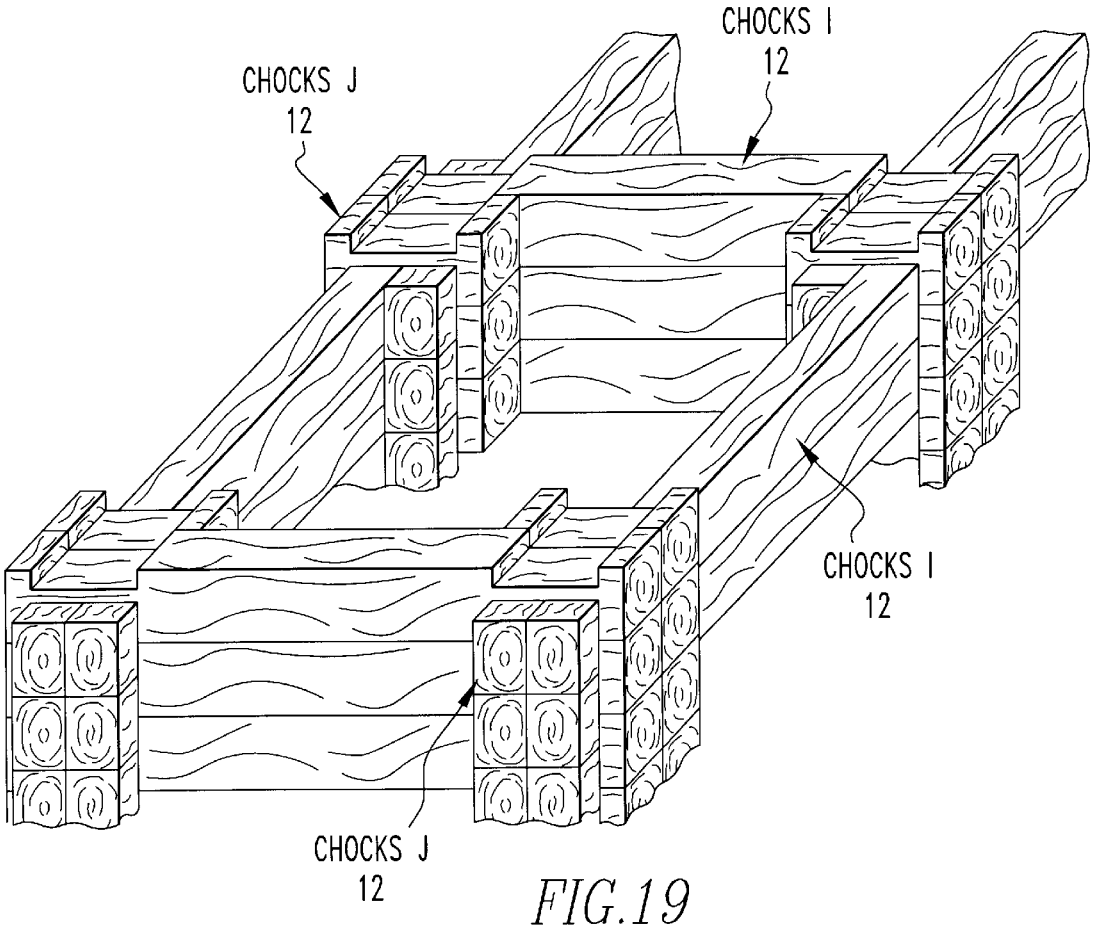
FIG. 19 shows stacking of chocks I & J.

FIG. 19. Shows stacking of chocks 12 I & J.

Figure 19A:
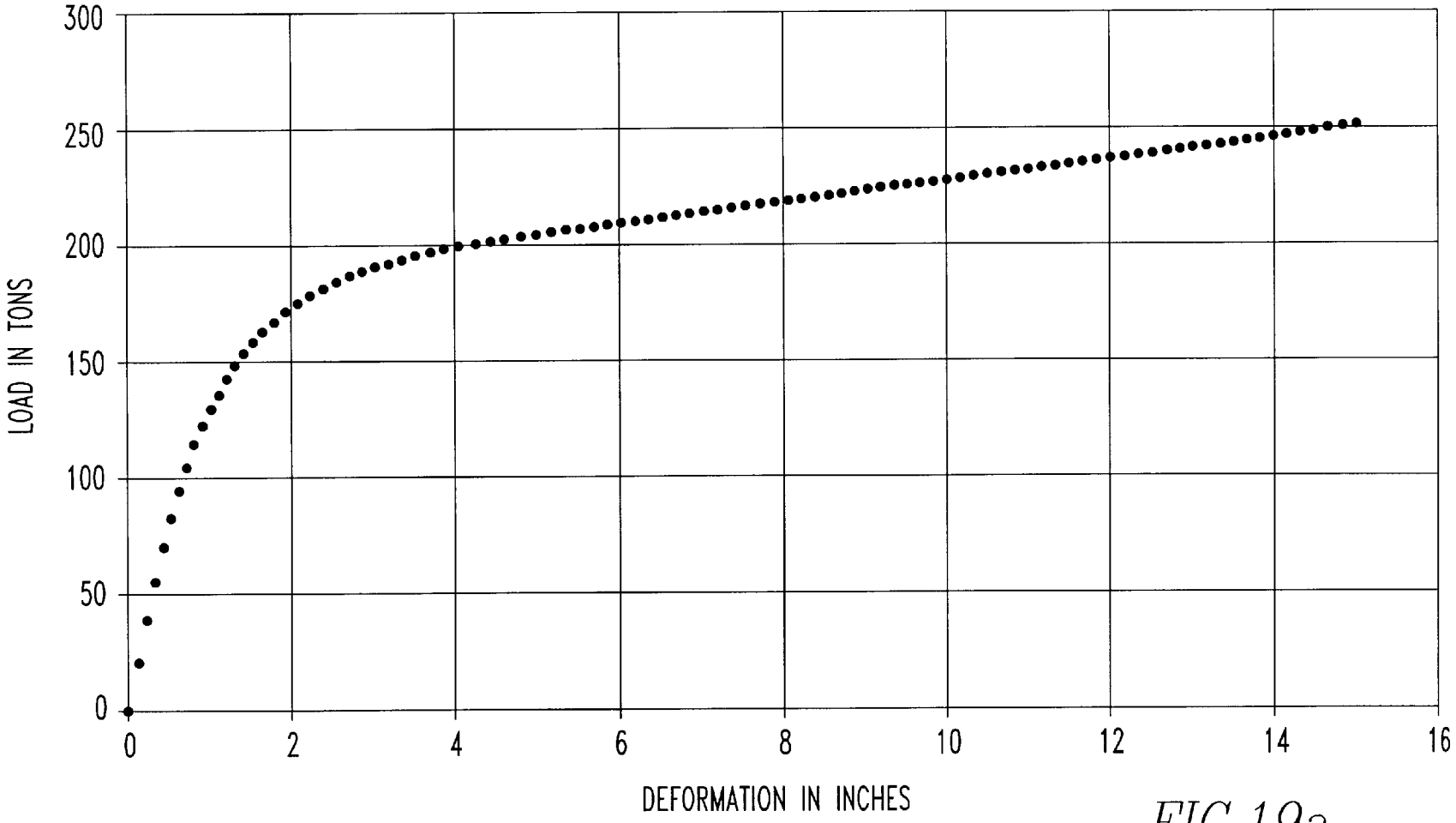
FIG. 19*a* shows a graph of support performance of interlocked chocks linking 24" chocks to create a 42" long×24" wide structure. All chocks 24" long×6" rise×3.5" wide, 48" high, in regard to FIGS. 16, 17, 18 and 19.

FIG. 19*a*. Shows a graph of support performance of interlocked chocks linking 24" chocks to create a 42" long×24" wide structure. All chocks 24" long×6" rise× 3.5" wide, 48" high, in regard to FIGS. 16, 17, 18 and 19.

Device 6—Means of securing above interlocked devices such that transport and placement of fully stacked or partially stacked structures is possible.

FIG. 20. Shows means of securing chocks 12 G as example with steel bands.

FIG. 21. Shows alternative means of securing chocks 12 G with steel bands.

FIG. 22. Shows means of securing chocks 12 G with a long tensioned rod 24 with counter-sunk end to allow compression of the structure.

Device is made functional as a support by filling in any space between the top end 75 of the support and the surface of the rock mass to be supported by one or more of the following methods.

Figure 24:
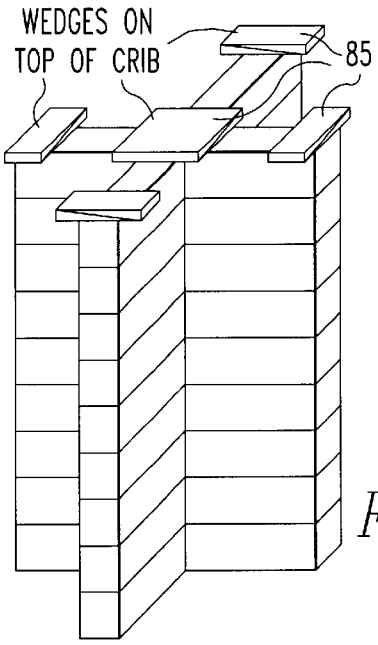
FIG. 24 is a schematic representation of a crib with wedges.
Figure 25:
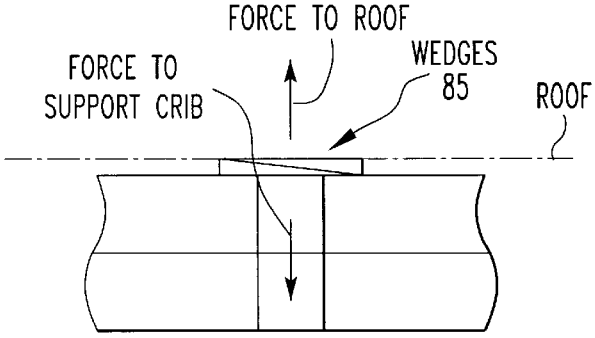
FIG. 25 is a force diagram of wedges, crib and mine.

Timber or metal blocking and wedges 85 installed either parallel to or perpendicular to the long axis of the chocks. This material would be installed preferably at the opposing ends of each chock and at the points of engagement of the notches, as shown in FIGS. 24 and 25.

Figure 27:
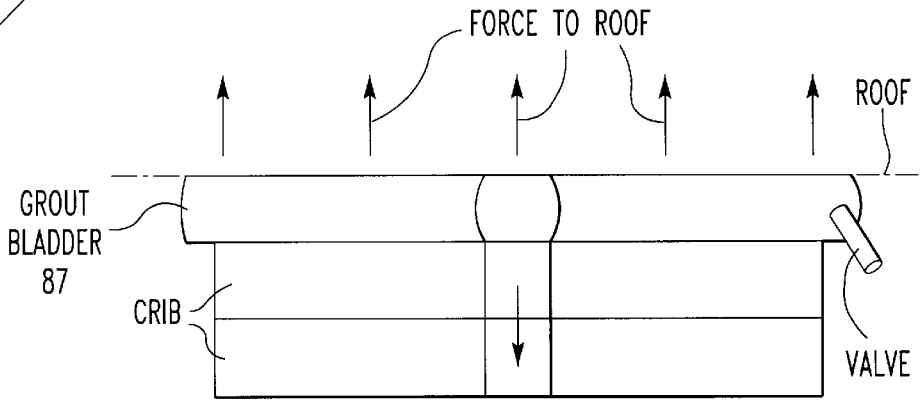
FIG. 27 is a force diagram of a bladder, crib and mine.
Figure 26:
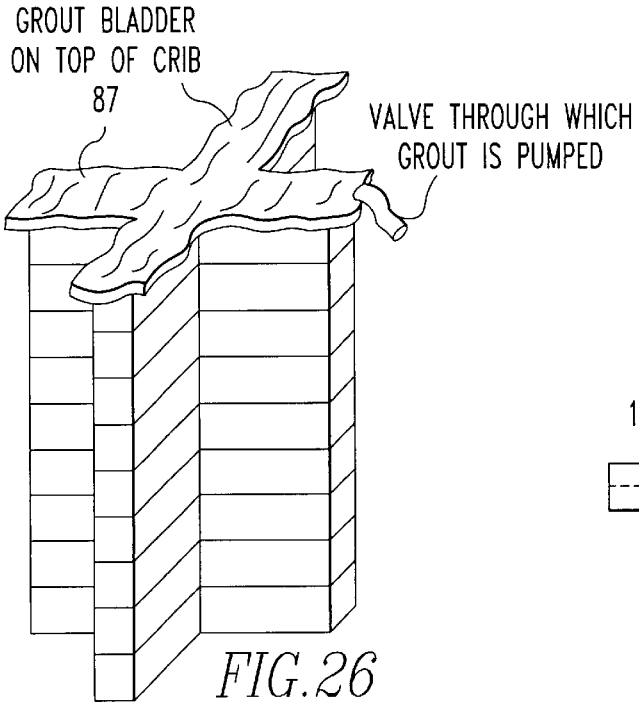
FIG. 26 is a schematic representation of a crib with a grout bladder.

Using grout bladders 87 into which a polymeric or cementitious grout can be pumped to fill in the space between the support and the rock surface, as shown in FIGS. 26 and 27. These grout bladders may be made to match the shape of the support or may be substantially larger and made to cover multiple supports installed in a given area.

Both of the above techniques if installed with sufficient force may enable the support to provide an active restraint and reinforcement effect to the rock mass.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A mine roof support crib comprising:

a plurality of chocks that are connected together through notches in the chocks to form only three vertically oriented planes with at least two of the planes in perpendicular relation with each other and able to support at least five tons of load, wherein the plurality of chocks are stacked on top of each other.

2. A crib as described and claim 1 in the plurality of chocks connected together can support at least 20 tons of load.

3. A crib as described in claim 2 wherein each chock has a long axis and each notch of the chock is cut at a right angle to the long axis of the chock.

4. A crib as described in claim 3 wherein each notch has at least one edge.

5. A crib as described in claim 4 wherein each notch has at least two edges.

6. A crib as described in claim 5 wherein each notch has at least two edges which are in parallel with each the other.

7. A crib as described in claim 6 wherein the rise of each chock is greater than the width of each chock.

8. A crib as described in claim 7 including a mechanism to hold the chocks together.

9. A crib as described in claim 8 wherein the holding mechanism includes at least one band wrapped around the chocks.

10. A crib as described in claim 9 wherein the width of each notch is two times the width of the chock and each plane comprises a first arm and a second arm which is offset from the first arm.

11. A crib as described in claim 8 wherein the holding mechanism includes at least one rod with a counter sink-end holding the chocks altogether.

12. A mine roof support crib comprising:

a plurality of chocks that are connected together through notches in the chocks to form only two vertically oriented planes which are in perpendicular relation with each other and are able to support at least five tons of load, wherein the plurality of chocks are stacked on top of each other.

13. A crib as described in claim 12 wherein the width of each chock is greater than the rise of each chock.

14. A crib as described in claim 13 wherein the plurality of chocks are connected together and able to support at least 100 tons of load.

15. A mine roof support crib comprising:

a plurality of chocks that are connected together through notches in the chocks to be able to support at least five tons of load, the plurality of chocks comprising a first type of chock having only one notch on a first side and a second type of chock having at least one notch on a second side, said plurality of chocks connected together, wherein the plurality of chocks are stacked on top of each other.

16. A crib as described in claim 15 wherein the second type of chock has only two notches on the second side.

17. A crib as described in claim 16 wherein the first type of chock has only one notch on a third side opposing the first side, and the second type of chock has only two notches on a fourth side opposing the second side.

18. A crib as described in claim 17 wherein the first type of chock and the second type of chock are each one continuous piece.

19. A crib as described in claim 15 wherein the second type of chock has only one notch on the second side.

20. A crib as described in claim 19 wherein the first type of chock, and the second type of chock each have a reinforcement mechanism attached to them.

21. A crib as described in claim 20 wherein the reinforcement mechanism includes a nail plate attached to each end of the first type of chock and the second type of chock.

22. A crib as described in claim 21 wherein the crib includes base end and top end pieces which provide a level and stable base and top to the crib.

23. A crib as described in claim 22 wherein the rise h=6 inches, the first type and second type of chock width=3.5 inches and the length of the first type and second type of chock=24 inches.

24. A method of forming a mine roof support crib comprising the steps of:

placing a first chock having only one notch on a first side in a mine;

linking a second chock having at least one notch on a second side with the one notch of the first chock;

linking a third chock having only one notch on a third side with one notch on a fourth side of the second chock opposing the second side; and linking a desired number of additional chocks onto each other or the first, second or third chocks through notches of the respective chocks until at least two planes are formed.

25. A method as described in claim 24 including after the linking a desired number of additional chocks, there is the step of supporting a load of at least 5 tons with the additional chocks and the first, second and third chocks.

26. A method as described in claim 25 including after the first chock placing step, there is the step of placing a fourth chock having only one notch on a first side in the mine; and wherein the second notch linking step includes the step of linking a second notch of the second chock having only the one notch and the second notch on the second side with the one notch of the fourth chock; and wherein the linking a desired number of additional chocks step includes the step of linking a desired number of additional chocks onto each other or the first, second, third or fourth chocks through notches of the respective chocks until only three planes are formed.

27. A method as described in claim 26 including before the placing step, there is the step of placing a base end piece on the mine floor to provide a level and stable base to the structure.

28. A method as described in claim 27 including after the linking a desired number of additional chocks step, there is the step of placing a top end piece on the top of the structure to complete the top of the structure.

29. A method as described in claim 28 including after the placing a top end piece step, there is the step of placing a holding mechanism about the chocks to hold them together.

* * * * *